US008434760B2

(12) United States Patent
Sadamitsu

(10) Patent No.: US 8,434,760 B2
(45) Date of Patent: May 7, 2013

(54) SHEET CONVEYING APPARATUS AND IMAGE FORMING APPARATUS

(75) Inventor: Yuushi Sadamitsu, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/421,059

(22) Filed: Mar. 15, 2012

(65) Prior Publication Data

US 2012/0248684 A1 Oct. 4, 2012

(30) Foreign Application Priority Data

Mar. 29, 2011 (JP) ..... 2011-071780

(51) Int. Cl.
*B65H 5/00* (2006.01)

(52) U.S. Cl.
USPC ..... 271/264; 271/272; 271/314

(58) Field of Classification Search ..... 271/264, 271/272, 275, 314
See application file for complete search history.

(56) References Cited

FOREIGN PATENT DOCUMENTS

| | | |
|---|---|---|
| JP | 3-065363 | 3/1991 |
| JP | 3-083750 | 4/1991 |
| JP | 7-277545 | 10/1995 |
| JP | 2807270 | 10/1998 |
| JP | 2934652 | 8/1999 |
| JP | 2000-038237 | 2/2000 |
| JP | 2009-173420 | 8/2009 |

*Primary Examiner* — David H Bollinger
(74) *Attorney, Agent, or Firm* — Fitzpatrick, Cella, Harper & Scinto

(57) ABSTRACT

A sheet conveying apparatus includes a conveying roller which conveys a sheet, a cylindrical motor which drives the conveying roller, an outer diameter of the motor being approximately equal to or smaller than an outer diameter of the conveying roller, and a supporting portion which supports the motor such that a rotational center of the motor is arranged coaxially with a rotational center of a rotational shaft of the conveying roller the motor is positioned within a maximum sheet that can be conveyed by the conveying roller in a width direction perpendicular to the sheet conveying direction.

13 Claims, 5 Drawing Sheets

SHEET CONVEYING APPARATUS AND IMAGE FORMING APPARATUS

BACKGROUND OF THE INVENTION

1. Field of the Invention

The present invention relates to a sheet conveying apparatus for conveying sheets and an image forming apparatus including the same.

2. Description of the Related Art

In general, an image forming apparatus includes a sheet conveying apparatus, and a conveying roller is widely used as a sheet conveying portion. In such a conveying roller, in order to drive the conveying roller device while supporting the roller shaft using bearings provided in both side frames of the conveying path, a driving conveyance mechanism such as a driving motor or a gear device is arranged at the near side or the inner side of an apparatus body.

In the image forming apparatus of the related art having such a configuration, members for supporting and driving the sheet conveying apparatus are arranged at both sides of the conveying path. Therefore, the depth of the apparatus significantly increases in comparison with the width of the sheet that can be conveyed through this conveying path. For this reason, the depth of the apparatus may significantly increase in comparison with the width of the conveyed sheet, and a mechanism for transmitting a driving force may become complicated.

In this regard, Japanese Patent Laid-Open No. 07-277545 discloses a sheet conveying apparatus adapted to drive a belt within a conveyance width of the sheet by integrating a conveying roller and a pulley. In this sheet conveying apparatus, both ends of a plurality of shafts where a plurality of feeding rollers is fixed is axially supported, pulleys are integrally provided in each of the intermediate portions of two feeding rollers, and additional pulleys are integrally provided in each intermediate portion of additional feeding rollers.

In addition, a toothed belt is suspended between each pulley of the two feeding rollers, and an additional toothed belt is suspended between the pulleys of the additional feeding rollers. One of the two feeding rollers and one of the additional feeding rollers are coaxially supported by a shaft, and the pulley installed in the rotational shaft of the motor arranged in the chassis meshes with the toothed belt suspended between the two feeding rollers. For this reason, as the motor is driven, a driving force of the motor is transmitted to each feeding roller through the shaft. As a result, the width of the sheet conveying apparatus is approximately equal to the width of the sheet conveying path so as to achieve miniaturization.

In addition, there has been proposed an image forming apparatus in which a gear is installed and driven in an intermediate portion of the roller to reduce the depth of the apparatus (refer to Japanese Patent Laid-Open No. 2000-038237). In such an image forming apparatus, a driving roller member having a roller in the shaft shorter than the width of the sheet is arranged in the conveying path including a feeding system and a receiving system arranged in the image forming apparatus. In addition, a gear is formed in the intermediate portion of the driving roller member so that a driving force is transmitted from one of a series of gears of the drive transmission system through a bevel gear. In addition, a driving force is transmitted in an intermediate portion of the roller by forwardly and reversely rotating the motor arranged in the driving device, where the roller member arranged in the sheet conveying path has a width shorter than the sheet width.

However, in the apparatuses disclosed in Japanese Patent Laid-Open Nos. 07-277545 and 2000-038237, the size of the apparatus body in the depth direction can be reduced. However, the size in the height or width direction increases accordingly. Therefore, it is difficult to implement a compact apparatus in its entire size.

The present invention provides a sheet conveying apparatus capable of implementing miniaturization of the entire size of the apparatus body by preventing projection in the depth, height, and width directions and an image forming apparatus including the same.

SUMMARY OF THE INVENTION

The present invention relates to a sheet conveying apparatus comprising a conveying roller which conveys a sheet in a sheet conveying direction; a cylindrical motor drives the conveying roller, an outer diameter of the motor being approximately equal to or smaller than an outer diameter of the conveying roller; and a supporting portion which supports the motor such that a rotational center of the motor is arranged coaxially with a rotational center of a rotational shaft of the conveying roller and the motor is positioned within a maximum sheet that can be conveyed by the conveying roller in a width direction perpendicular to the sheet conveying direction.

According to the present invention, since the outer diameter of the motor is set to be approximately equal to or smaller than that of the conveying roller, the apparatus size in the depth, height, and width directions can be miniaturized. As a result, a compact apparatus in its entire size can be implemented.

Further features of the present invention will become apparent from the following description of exemplary embodiments with reference to the attached drawings.

DESCRIPTION OF THE EMBODIMENTS

Hereinafter, exemplary embodiments of the invention will be described in detail with reference to the accompanying drawings. Dimensions, materials, shapes, relative arrangement of components described in the following embodiments may be properly modified depending on a structure of the apparatus of the invention or various conditions. Therefore, unless specified otherwise, the embodiments are not intended to limit the scope of the invention thereto.

Figure 1:
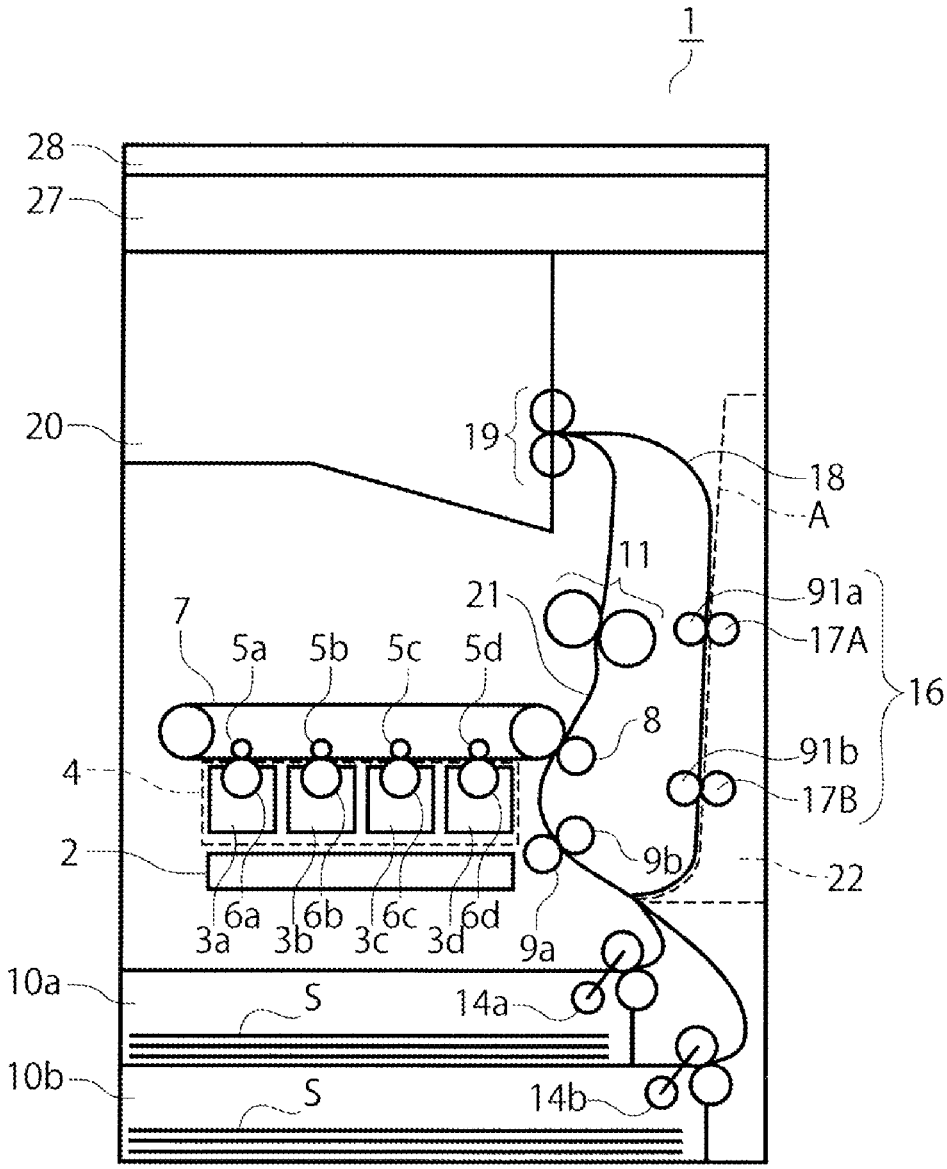
FIG. 1 is a cross-sectional view illustrating the entire image forming apparatus according to an embodiment of the invention.

<First Embodiment> A sheet conveying apparatus and an image forming apparatus 1 including the same according to the present embodiment will be described in detail with reference to FIGS. 1 to 4 and FIG. 5A. FIG. 1 is a cross-sectional view illustrating the entire image forming apparatus 1 according to the present embodiment.

As illustrated in FIG. 1, a scanner unit 27 as an original image reader portion and an original pressing portion 28 for pressing the original to an original base plate are arranged in the upper part of the image forming apparatus 1. An image forming unit 4 for forming an image on the sheet and a reversing unit 16 for reversing the sheet are arranged in the center of the image forming apparatus 1. In addition, feeder units 10*a* and 10*b* as a feeder portion for feeding the stored sheets S are arranged in the lower part.

The reversing unit 16 included in the sheet conveying apparatus according to an embodiment of the invention includes reverse conveying rollers 17A and 17B and reversing rollers 91*a* and 91*b* as a follower roller following the reverse conveying rollers 17*a* and 17*b*, respectively, to reverse the fixed sheet S.

The image forming unit 4 as an image forming portion has four imaging units 3*a*, 3*b*, 3*c*, and 3*d*. The imaging units 3*a* to 3*d* including process cartridges have photosensitive drums 6*a*, 6*b*, 6*c*, and 6*d*, respectively, for forming toner images of yellow, magenta, cyan, and black, respectively. Around each of the photosensitive drums 6*a* to 6*d*, a charging device, a developing device, and a cleaner (not illustrated) are arranged.

On top of the image forming unit 4, an intermediate transfer belt 7 as an intermediate transfer portion is arranged to make contact with each of the photosensitive drums 6*a* to 6*d*. An exposure unit 2 as an exposure portion is arranged beneath the image forming unit 4.

Each of the photosensitive drums 6*a* to 6*d* is charged by the charging device (not illustrated). The exposure unit 2 exposes an optical image chromatically separated into yellow, magenta, cyan, and black onto the photosensitive drums 6*a* to 6*d*, respectively. As a result, latent images of yellow, magenta, cyan, and black are formed on the photosensitive drums 6*a* to 6*d*, respectively. Each latent image is developed by the developing unit (not illustrated), and toner images of yellow, magenta, cyan, and black are formed on the photosensitive drums 6*a* to 6*d*, respectively.

As each photosensitive drum 6*a* to 6*d* is rotated, the toner images on the photosensitive drums 6*a* to 6*d* arrive at the primary transfer portion on the intermediate transfer belt 7. Each toner image is sequentially transferred onto the intermediate transfer belt 7 by the primary transfer rollers 5*a*, 5*b*, 5*c*, and 5*d* arranged to face the photosensitive drums 6*a* to 6*d*, respectively. A primary transfer bias is applied to the primary transfer rollers 5*a* to 5*d* from an electric board (not illustrated).

The sheets S stored in the feeder units 10*a* and 10*b* are discharged one by one through pickup rollers 14*a* and 14*b*. In addition, the timings of the sheets S are aligned by registration rollers 9*a* and 9*b*, and then, the sheets S are conveyed to a nip portion (secondary transfer portion) including a secondary transfer roller 8 and the intermediate transfer belt 7 so that the toner images of the intermediate transfer belt 7 are transferred collectively as a secondary transfer operation.

Then, the sheet S on which the toner images are transferred is conveyed to a fixing unit 11. The fixing unit 11 fixes the toner images by applying heat and pressure to the sheet S. As a result, toners of each color are melted, chromatically mixed, and fixed to the sheet S so as to form a full-color print image. In addition, the sheet S is discharged to the discharge tray 20 by a discharge conveying portion 19 provided in the downstream of the fixing unit 11.

The reversing unit 16 for reversing the sheet S to which the toner images have been fixed is used to convey the sheet S to the secondary transfer portions 7 and 8 again in order to transfer the toner images to the rear surface of the sheet S for which the secondary transfer has been already performed. The sheet S for which the secondary transfer is performed on a first surface using the secondary transfer portions 7 and 8 passes through the fixing unit 11 and is halted while a part of the sheet S is injected from the discharge conveying portion 19 so that an upstream side of the sheet is guided to the reverse conveying path 18. In addition, the sheet S passes through the reverse conveying rollers 17A and 17B and reversely conveyed to the registration rollers 9*a* and 9*b* so that the timing is aligned by registration rollers 9*a* and 9*b*. Then, a secondary transfer operation is performed on a second surface for the sheet S using the secondary transfer portions 7 and 8, and the toner images are fixed by the fixing unit 11. Then, the sheet S is discharged to the discharge tray 20 through the discharge conveying portion 19.

Figure 2A:
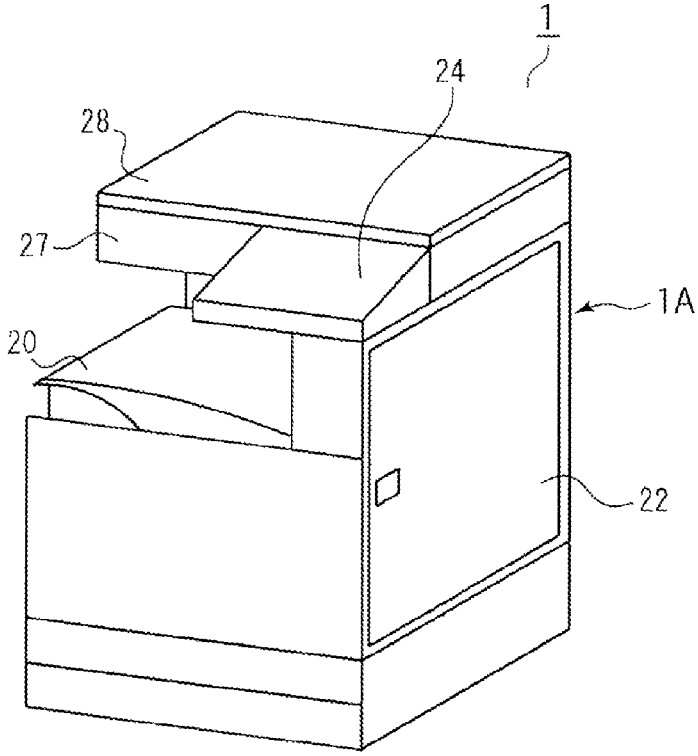
FIG. 2A is a perspective view illustrating the entire image forming apparatus according to an embodiment of the invention in a state that the side cover is closed.
Figure 2B:
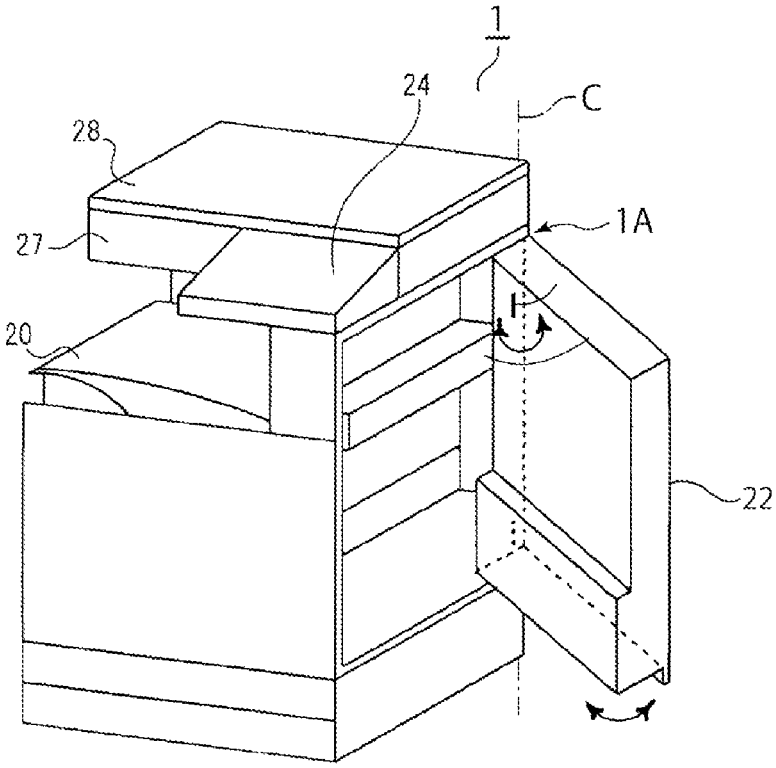
FIG. 2B is a perspective view illustrating a state that the side cover is opened.
Figure 3:
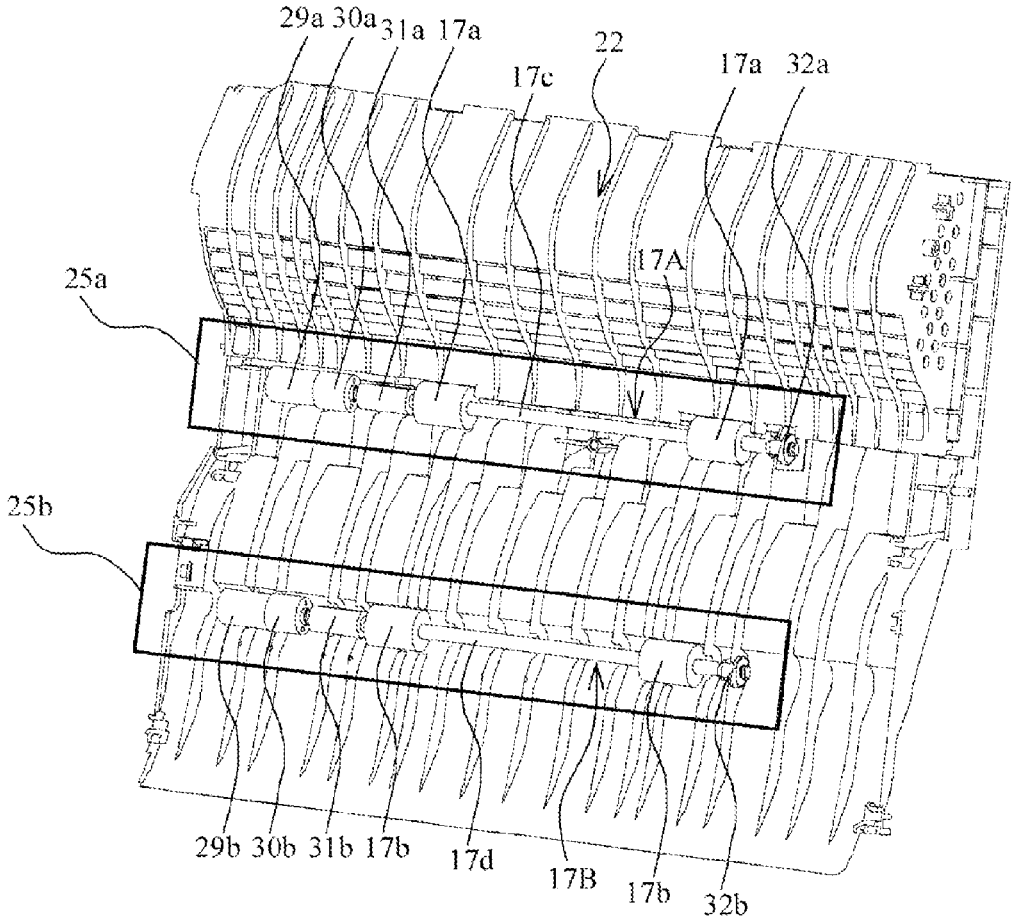
FIG. 3 is a perspective view illustrating a side cover of the image forming apparatus according to a first embodiment of the invention.
Figure 4:
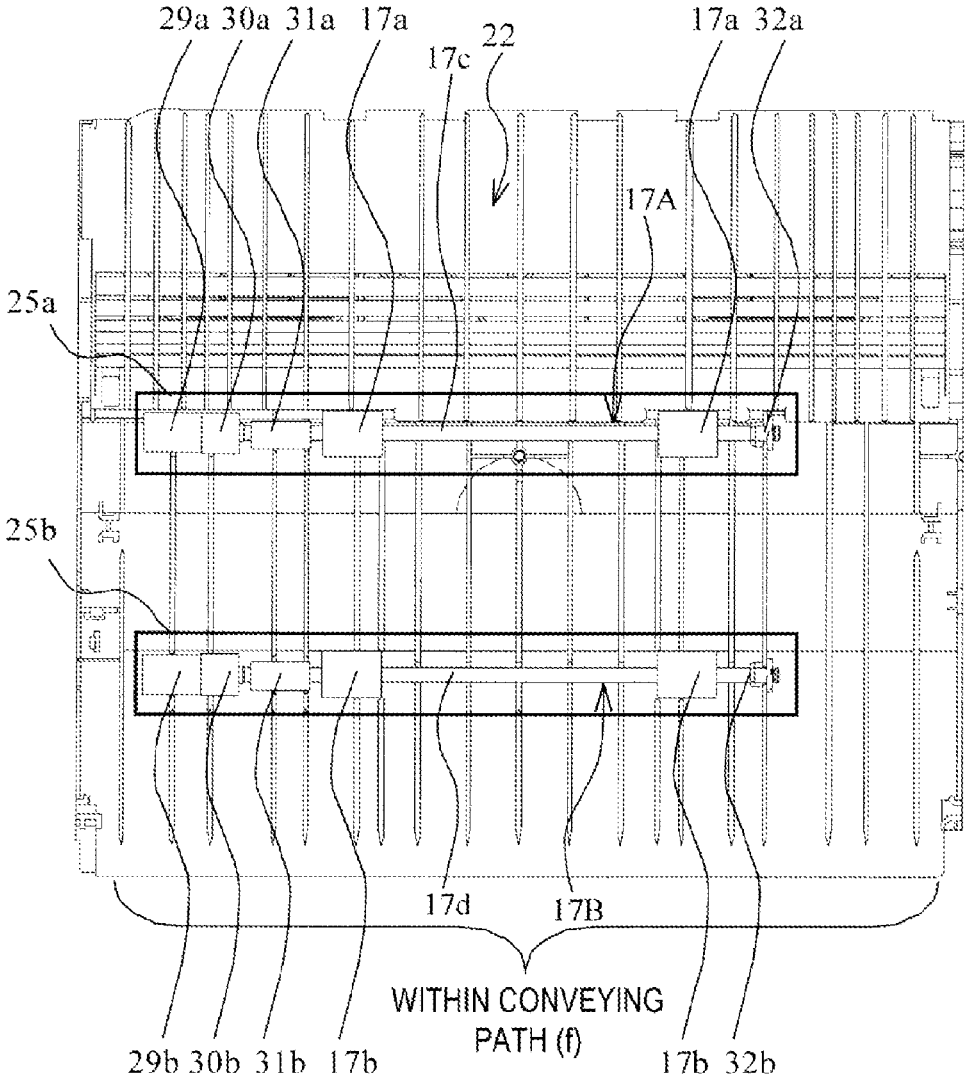
FIG. 4 is a front view illustrating a side cover of the image forming apparatus according to the first embodiment of the invention.
Figure 5A:
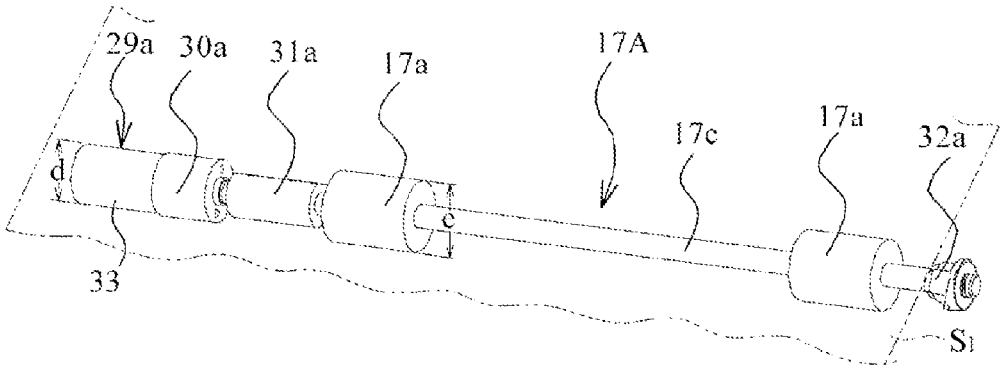
FIG. 5A is a perspective view illustrating a driving unit (driving device) according to the first embodiment of the invention in detail.

Next, a driving configuration according to an embodiment of the invention will be described. FIG. 2A is a perspective view illustrating a state that the side cover 22 of the image forming apparatus 1 is closed. FIG. 2B is a perspective view illustrating a state that the side cover 22 is opened. FIG. 3 is a perspective view illustrating the side cover 22 which is opened. FIG. 4 is a front view illustrating the side cover 22 which is opened. FIG. 5A is a perspective view illustrating a driving unit according to the first embodiment of the invention in detail.

As illustrated in FIGS. 2A and 2B, the side cover 22 is pivotably supported by a hinge relative to the apparatus body 1A with respect to the pivot center C vertically extending at the inner side of the body 1A of the image forming apparatus 1. The side cover 22 constitutes a part of the apparatus body of the sheet conveying apparatus as well as a part of the apparatus body 1A.

The side cover 22 is divided from the apparatus body 1A of the image forming apparatus 1 along the boundary indicated by the dotted line A in FIG. 1. The side cover 22 included as a part of the apparatus body 1A of the image forming apparatus 1 as well as a part of the apparatus body of the sheet conveying apparatus is integrally provided with the reverse conveying rollers 17A and 17B as a conveying roller. In addition, the reversing rollers 91*a* and 91*b* that follow the reverse conveying rollers 17A and 17B, respectively, are provided at the side pivotably supporting the side cover 22 included as a part of the apparatus body 1A of the image forming apparatus 1 as well as a part of the apparatus body of the sheet conveying apparatus. The reverse conveying path 18 is opened by opening the side cover 22. In FIG. 2, an operation portion 24 for performing various manipulations is provided.

In addition, the reverse conveying rollers 17A and 17B and the reversing rollers 91*a* and 91*b* may be arranged oppositely to those described above. That is, the reversing rollers 91*a* and 91*b* may be supported by the side cover 22 included as a part of the apparatus body 1A of the image forming apparatus 1 as well as a part of the apparatus body of the sheet conveying apparatus. In addition, the reverse conveying rollers 17A and 17B may be supported at the side pivotably supporting the side cover 22 included as a part of the apparatus body 1A of the image forming apparatus 1 as well as a part of the apparatus body of the sheet conveying apparatus. Similar effects can also be obtained in this case.

As illustrated in FIGS. 3 and 4, the side cover 22 is provided with driving units 25*a* and 25*b*. The driving unit 25*a* includes a motor 29*a*, a drive transmission portion 30*a*, a coupling 31*a*, a reverse conveying roller 17A, and a bearing 32*a* arranged in a uniaxial shape along a horizontal direction perpendicular to the vertical direction. In addition, the driving unit 25*b* includes a motor 29*b*, a drive transmission portion 30*b*, a coupling 31*b*, a reverse conveying roller 17B, and a bearing 32*b* arranged in a uniaxial shape along a horizontal direction perpendicular to the vertical direction. The driving units 25*a* and 25*b* are arranged separately from each other in parallel with a predetermined vertical distance. The "uniaxial shape" means a state that each member is successively arranged side by side along an axial direction while their axial positions are different. That is, the motor 29*a* is provided coaxially with the pivot axis of the reverse conveying roller 17A. In addition, the motor 29*b* is provided coaxially with the pivot axis of the reverse conveying roller 17B.

The reverse conveying roller 17A includes a rotational shaft 17*c* and roller bodies 17*a* and 17*a* fixed to both ends of the rotational shaft 17*c*. In addition, the reverse conveying roller 17B includes a rotational shaft 17*d* and roller bodies 17*b* and 17*b* fixed to both ends of the rotational shaft 17*d*. According to the present embodiment, a pair of roller bodies 17*a* (or 17*b*) is provided at both ends of the rotational shaft 17*c* (or 17*d*). However, at least one roller body 17*a* (or 17*b*) may be further arranged between the roller bodies 17*a* and 17*a* (or between 17*b* and 17*b*). Similar effects can also be obtained in this case, and this may be similarly applied to the second and third embodiments described below.

Each motor body 33 of the motors 29*a* and 29*b* is fixed to the side cover 22 serving as a supporting portion which supports the motors 29*a* and 29*b* using a support member (not illustrated). Therefore, one end of the rotational shaft 17*c* to which one of the roller bodies 17*a*, 17*a* is fixed is supported by the motor 29*a* fixed to the side cover 22 through the drive transmission portion 30*a* and the coupling 31*a*. The other end of the rotational shaft 17*c* to which the other side of the roller bodies 17*a*, 17*a* is fixed is rotatably supported by the bearing 32*a* fixed to the side cover 22. In addition, one end of the rotational shaft 17*d* to which one end of the roller bodies 17*b*, 17*b* is fixed is supported by the motor 29*b* fixed to the side cover 22 through the drive transmission portion 30*b* and the coupling 31*b*. The other end of the rotational shaft 17*d* to which the other side of the roller bodies 17*b*, 17*b* is fixed is rotatably supported by the bearing 32*b* fixed to the side cover 22.

The drive transmission portions 30*a* and 30*b* may include, for example, a decelerator using a planet gear arranged coaxially with each shaft (driving shaft) of the motors 29*a* and 29*b* to transmit a driving force. In this case, the driving torque of the motors 29*a* and 29*b* can be transmitted to the reverse conveying rollers 17B and 17B while the driving torque is larger than the deceleration of the decelerator. In addition, it is possible to arrange the drive transmission portions 30*a* and 30*b* with a smaller space by miniaturizing the drive transmission portions 30*a* and 30*b*.

Next, a structure of the motors 29*a* and 29*b* will be described with reference to FIG. 5A. Since the motors 29*a* and 29*b* have the same configuration, description of FIG. 5A will be made by focusing on the motor 29*a*.

The motor 29*a* is arranged on the line extending from the rotational shaft 17*c* with a small distance in an axial direction from the reverse conveying roller 17A. The motor body 33 is fixed to the side cover 22 such that the roller bodies 17*a* and 17*a* are rotated through the drive transmission portion 30*a* and the coupling 31*a*. The motor 29*a* has a generally cylindrical shape and is arranged at one end of the rotational shaft 17*c*. The motor 29*a* includes a cylindrical motor body 33 and a shaft (not illustrated) provided coaxially with the motor body 33. The outer diameter d of the cylindrical portion (that is, motor body 33) of the motor 29*a* is set to be approximately equal to or smaller than the outer diameter e of the roller bodies 17*a* and 17*a*. In addition, the motor 29*a* is positioned within an area corresponding to the width of the sheet S in a width direction perpendicular to the conveying direction of the sheet S conveyed by the reverse conveying roller 17A. In this case, for example, the motor 29*a* may be positioned within the maximum width of the sheet S in the axial direction of the reverse conveying roller 17A. FIG. 5A schematically illustrates a state that the sheet S1 is conveyed, for example, by the reverse conveying roller 17A.

According to the present embodiment, a drive transmission portion 30*a* including a decelerator or the like is interposed between the motor 29*a* and the rotational shaft 17*c*. In addition, the motor 29*a* also serves as a guide for guiding the sheet S conveyed by the reversing unit 16 as a conveying portion including the reverse conveying rollers 17A and 17B provided in the side cover 22. That is, since the motor body 33 is set to be within the outer diameter e of the roller body 17*a* (the outer diameter of the motor 29*a* is approximately equal to or smaller than the outer diameter e of the roller body 17*a*), it can serve as a conveying path, that is, a guide for guiding the conveyed sheet. In addition, if the motor 29*a* is positioned within the maximum width of the sheet, a small-sized sheet may be deviated from the guide of the motor 29*a* with respect to both sides. However, most sizes of sheets can be stably guided, and reliability of the guide function can be improved. Therefore, it is possible to stably guide the sheet end using the guide of the motor 29*a* and stabilize the conveyance state of the sheet when the sheet S is conveyed by the reverse conveying rollers 17A and 17B (and the reversing rollers 91*a* and 91*b*). This may be similarly applied to the second and third embodiments described below.

By virtue of the aforementioned configuration, a driving force of the motor 29*a* is transmitted to the reverse conveying roller 17A through the drive transmission portion 30*a* and the coupling 31*a*, and a driving force of the motor 29*b* is transmitted to the reverse conveying roller 17B through the drive transmission portions 30*b* and the coupling 31*b* so that stable sheet conveyance can be implemented. In addition, the cylindrical motor body 33 may be formed in a slightly narrow shape, and a cylindrical member made of synthetic resin and the like may be fit into the outer side thereof so as to form a motor body assembly. An outer diameter of the entire motor body assembly including the cylindrical motor body 33 and the cylindrical member may be set as the outer diameter d. This may be similarly applied to the second and third embodiments described below.

According to the present embodiment, the driving units 25*a* and 25*b* are arranged within a conveying path (the maximum width of the sheet that can be conveyed in the width direction of the sheet). For this reason, the sheet S conveyed by the rotation of the reverse conveying rollers 17A and 17B is smoothly conveyed such that it passes through the area f denoted by "within conveying path" in FIG. 4 in the width direction thereof (horizontal direction in FIG. 4). Furthermore, while the motors 29*a* and 29*b* of the driving units 25*a* and 25*b*, respectively, are arranged coaxially with the reverse conveying rollers 17A and 17B in the axial direction, each outer diameter d is set to be approximately equal to or smaller than the outer diameter e of the reverse conveying rollers 17A and 17B.

By virtue of the aforementioned configuration, it is possible to implement miniaturization in the overall directions including depth, width, and height directions of the image forming apparatus 1 including the sheet conveying apparatus without influencing the sheet passing. In addition, it is possible to simplify a drive transmission system for the reverse conveying rollers 17A and 17B. The lengths of the reverse conveying rollers 17A and 17B in the width direction perpendicular to the sheet conveying direction can be set to be smaller than the sheet width so that a driving mechanism suitable for device miniaturization can be provided. Such advantages may be similarly obtained from the second and third embodiments.

Figure 5B:
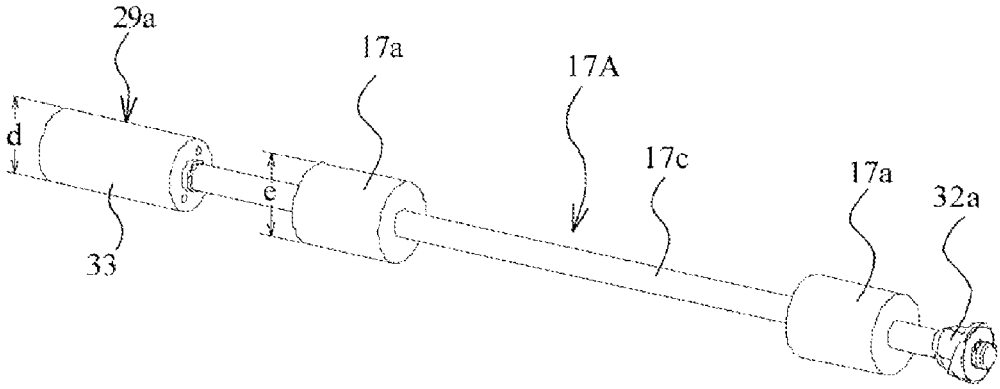
FIG. 5B is a perspective view illustrating a driving unit according to a second embodiment of the invention.

<Second Embodiment> FIG. 5B is a perspective view illustrating a driving unit according to a second embodiment of the invention in detail. The present embodiment is different from the first embodiment in that the drive transmission portion 30*a* and the coupling 31*a* are not provided, and other configurations are similar. Therefore, like reference numerals denote like elements, and description thereof will not be repeated. Since the configurations of the motors 29*a* and 29*b* are similar, description will be made by focusing on the motor 29*a*.

According to the present embodiment, as illustrated in FIG. 5B, the motor 29*a* is arranged on the line extending from the rotational shaft 17*c* with a distance from the reverse conveying roller 17A in the axial direction. In addition, the motor body 33 is fixed to the side cover 22 by a support member (not illustrated) so as to directly rotate the roller bodies 17*a* and 17*a*. That is, one end of the rotational shaft 17*c* is integrated with the motor body 33 of the motor 29*a* as a shaft (driving shaft) of the motor 29*a* so that an extension of the rotational shaft 17*c* protruding from one side of the roller bodies 17*a* and 17*a* is directly connected to the motor 29*a*. The outer diameter d of the cylindrical motor body 33 of the motor 29*a* is set to be approximately equal to or smaller than the outer diameter e of the roller body 17*a*, and the area f corresponding to "within conveying path" is arranged within the maximum width of the conveyed sheet.

According to the present embodiment, since the motors 29*a* and 29*b* and the reverse conveying rollers 17A and 17B are directly connected, respectively, it is possible to remove the space occupied by the drive transmission portions 30*a* and 30*b* and the couplings 31*a* and 31*b*. Therefore, it is possible to further save the space.

Figure 5C:
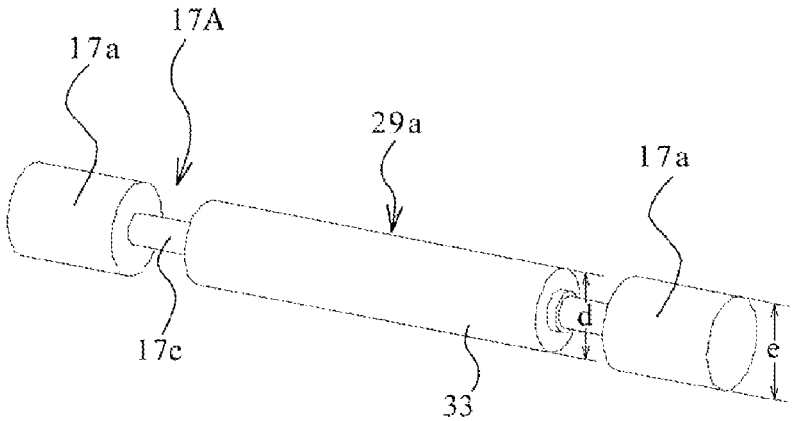
FIG. 5C is a perspective view illustrating a driving unit according to a third embodiment of the invention.

<Third Embodiment> FIG. 5C is a perspective view illustrating the driving unit according to a third embodiment of the invention in detail. Similarly, in the present embodiment, like reference numerals denote like elements, and description thereof will not be repeated. In addition, since the motors 29*a* and 29*b* have the same configuration, description will be made by focusing on the motor 29*a*.

According to the present embodiment, a pair of roller bodies 17*a* and 17*a* is arranged at both ends of the rotational shaft 17*c*, and the motor 29*a* is arranged between the roller bodies 17*a* and 17*a* in the rotational shaft 17*c*. That is, the rotational shaft 17*c* is integrally connected to both sides of the motor body 33 of the motor 29*a* as a shaft (driving shaft) of the motor 29*a*. The motor 29*a* (motor body 33) according to the present embodiment has a length longer than that of the motor 29*a* (motor body 33) described in conjunction with FIGS. 5A and 5B along the axial direction.

Similarly, according to the present embodiment, the motor body 33 has a cylindrical shape, and the outer diameter d thereof is set to be approximately equal to or smaller than the outer diameter e of the roller bodies 17*a* and 17*a*. In addition, since the motor 29*a* is arranged in approximately the center of the roller bodies 17*a* and 17*a*, it is naturally positioned within the maximum width of the conveyed sheet.

According to the present embodiment, since the motor 29*a* is arranged in the center of the reverse conveying roller 17A, it is possible to further save the space. In addition, since a driving force is transmitted in the center, it is possible to improve a balance for transmitting a driving force to the sheet S and prevent a skew feeding of the sheet S.

Unlike the first embodiment, the motors 29*a* and 29*b* according to the second and third embodiments do not have the drive transmission portions 30*a* and 30*b* such as a decelerator. However, the drive transmission portions 30*a* and 30*b* may be internally provided even in the second and third embodiments.

Although the motors 29*a* and 29*b* and the reverse conveying rollers 17A and 17B are supported by the side cover 22 according to the second and third embodiments, they may be supported also by the apparatus body 1A.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-071780, filed Mar. 29, 2011, which is hereby incorporated by reference herein in its entirety.

What is claimed is:

1. A sheet conveying apparatus comprising:

a conveying roller which conveys a sheet in a sheet conveying direction; and a cylindrical motor which drives the conveying roller, an outer diameter of the motor being approximately equal to or smaller than an outer diameter of the conveying roller, wherein the conveying roller and the cylindrical motor are disposed coaxially, and in a width direction perpendicular to the sheet conveying direction, the motor is positioned within a width of a maximum size sheet which can be conveyed by the conveying roller.

2. The sheet conveying apparatus according to claim 1, wherein the motor is arranged at one end of a rotational shaft of the conveying roller.

3. The sheet conveying apparatus according to claim 1, wherein the conveying roller has a plurality of roller bodies of which outer peripheries make contact with the sheet, and the motor is arranged between a plurality of the roller bodies.

4. The sheet conveying apparatus according to claim 1, wherein the motor and a rotational shaft of the conveying roller are connected using a coupling.

5. The sheet conveying apparatus according to claim 4, further comprising a drive transmission portion configured to transmit a drive torque of the motor to the conveying roller, wherein the drive transmission portion is interposed between the motor and the coupling.

6. The sheet conveying apparatus according to claim 1, wherein a rotational shaft of the conveying roller is integrated with a driving shaft of the motor.

7. An image forming apparatus comprising:

a conveying roller which conveys a sheet;

a cylindrical motor which drives the conveying roller, an outer diameter of the motor being approximately equal to or smaller than an outer diameter of the conveying roller; and an image forming portion which forms an image on the sheet, wherein the conveying roller and the cylindrical motor are disposed coaxially, and in a width direction perpendicular to the sheet conveying direction, the motor is positioned within a width of a maximum size sheet which can be conveyed by the conveying roller.

8. The image forming apparatus according to claim 7, wherein the motor is arranged at one end of a rotational shaft of the conveying roller.

9. The image forming apparatus according to claim 7, wherein the conveying roller includes a plurality of roller bodies of which outer peripheries make contact with the sheet, and the motor is arranged between a plurality of the roller bodies.

10. The image forming apparatus according to claim 7, wherein the motor and a rotational shaft of the conveying roller are connected using a coupling.

11. The image forming apparatus according to claim 10, further comprising a drive transmission portion configured to transmit a drive torque of the motor to the conveying roller, wherein the drive transmission portion is interposed between the motor and the coupling.

12. The image forming apparatus according to claim 7, wherein a rotational shaft of the conveying roller is integrated with a driving shaft of the motor.

13. A sheet conveying apparatus comprising:

a conveying roller which conveys a sheet in a sheet conveying direction; and a cylindrical motor which drives the conveying roller, and outer diameter of the motor being approximately equal to or smaller than an outer diameter of the conveying roller, wherein the conveying roller and the cylindrical motor are disposed coaxially, and the motor serves as a guide for guiding the sheet conveyed by the conveying roller.

* * * * *